US011565300B2

(12) United States Patent
Nillies

(10) Patent No.: US 11,565,300 B2
(45) Date of Patent: Jan. 31, 2023

(54) METHOD AND DEVICE FOR SPIN FORMING

(71) Applicant: Leifeld Metal Spinning AG, Ahlen (DE)

(72) Inventor: Benedikt Nillies, Ahlen (DE)

(73) Assignee: Leifeld Metal Spinning AG, Ahlen (DE)

( * ) Notice: Subject to any disclaimer, the term of this patent is extended or adjusted under 35 U.S.C. 154(b) by 153 days.

(21) Appl. No.: 16/476,013

(22) PCT Filed: Oct. 17, 2017

(86) PCT No.: PCT/EP2017/076444

§ 371 (c)(1),
(2) Date: Jul. 3, 2019

(87) PCT Pub. No.: WO2018/133959

PCT Pub. Date: Jul. 26, 2018

(65) Prior Publication Data

US 2019/0374991 A1 Dec. 12, 2019

(30) Foreign Application Priority Data

Jan. 18, 2017 (EP) ..... 17151935

(51) Int. Cl.
*B21D 22/14* (2006.01)

(52) U.S. Cl.
CPC ..... *B21D 22/14* (2013.01)

(58) Field of Classification Search
CPC ..... B21D 22/14; B21D 22/16; B21D 22/18; B21D 53/26; B21D 53/30
(Continued)

(56) References Cited

U.S. PATENT DOCUMENTS 3,287,951 A 11/1966 Widera
3,779,060 A * 12/1973 Schroder ..... B21D 53/30 72/87

(Continued)

FOREIGN PATENT DOCUMENTS

CN 103108709 A 5/2013
DE 3545506 A1 7/1987

(Continued)

OTHER PUBLICATIONS

International Search Report issued in PCT/EP2017/076444; dated Jan. 26, 2018.

(Continued)

*Primary Examiner* — Shelley M Self
*Assistant Examiner* — Jared O Brown
(74) *Attorney, Agent, or Firm* — Studebaker & Brackett PC

(57) ABSTRACT

A method and a device for spin forming includes a workpiece set in rotation with a spindle and at least one outer roller is positioned at an outer side of the workpiece. With material thinning, an axially extending lateral region of the workpiece is shaped. At least one inner roller is positioned at an inner side of the workpiece with an inner support, which is displaceable axially and radially relative to the axis of rotation independently of the outer roller. The inner support with the inner roller and an outer support with the outer roller are displaced individually with a CNC control unit, forming at the lateral region a defined wall thickness profile with different wall thicknesses between the at least one outer roller and the at least one inner roller.

7 Claims, 4 Drawing Sheets

Figure 1:
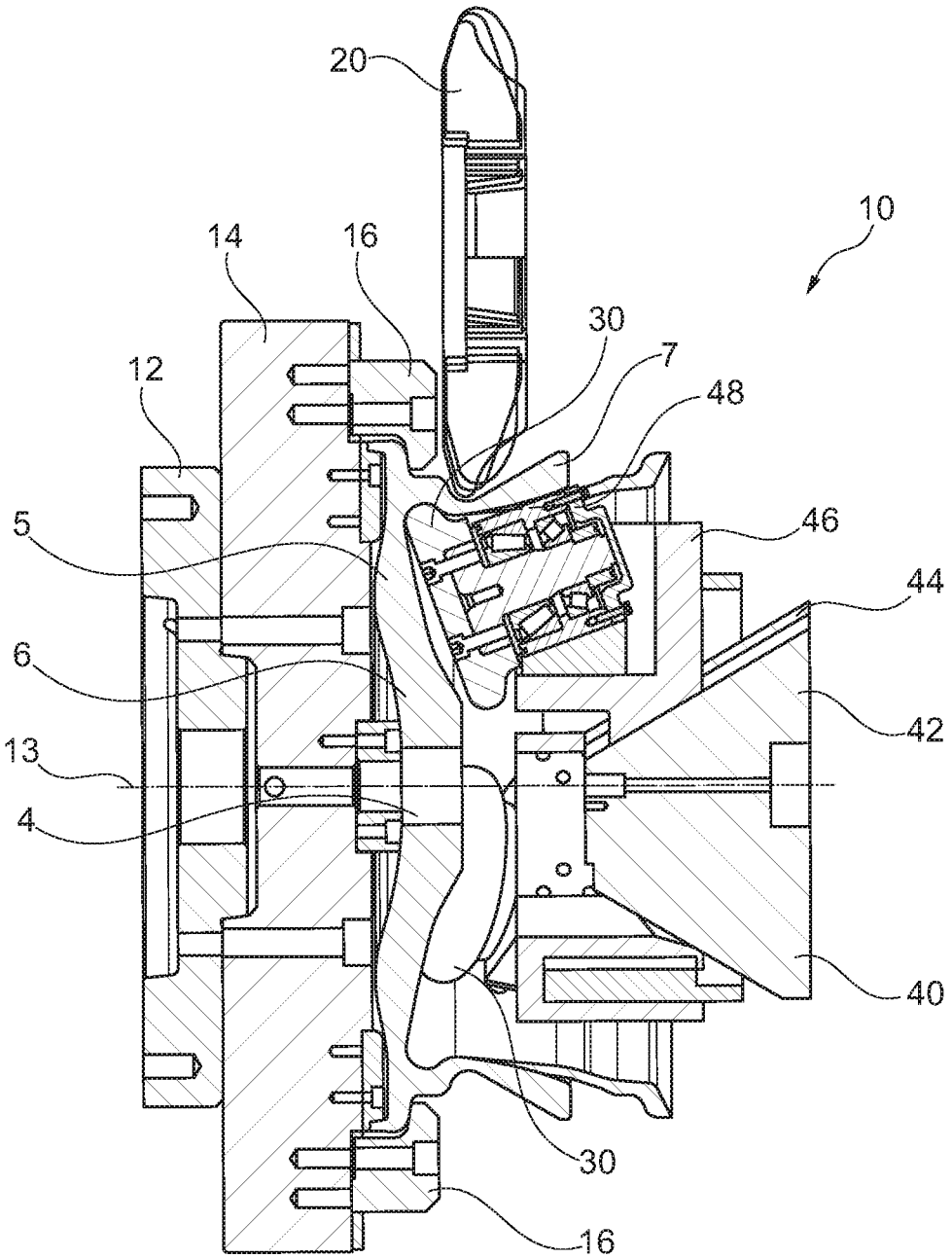

(58) Field of Classification Search
USPC ..... 72/105–107, 110; 29/894.354
See application file for complete search history.

(56) References Cited

U.S. PATENT DOCUMENTS

| | | | | | |
|---|---|---|---|---|---|
| 3,823,591 | A * | 7/1974 | Schroder | B21D 22/16 | 72/85 |
| 3,846,886 | A * | 11/1974 | Schroder | B21D 53/30 | 29/894.354 |
| 4,766,752 | A * | 8/1988 | Gronert | B21B 19/14 | 72/110 |
| 6,279,230 | B1 * | 8/2001 | Eikhoff | B21D 53/32 | 29/894.38 |
| 9,573,179 | B2 * | 2/2017 | Muffatto | B21D 5/004 | |
| 9,597,721 | B2 * | 3/2017 | Allwood | B21D 22/14 | |
| 10,549,468 | B2 * | 2/2020 | Ogishi | B21D 22/18 | |
| 2008/0314113 | A1 * | 12/2008 | Minoguchi | F15B 15/1438 | 72/370.06 |
| 2013/0152652 | A1 | 6/2013 | Allwood et al. | | |

FOREIGN PATENT DOCUMENTS

| | | | | | |
|---|---|---|---|---|---|
| DE | 102010000004 | A1 | | 7/2011 | |
| DE | 102011117034 | A1 | | 5/2013 | |
| DE | 102010000004 | B4 | * | 5/2022 | B21D 41/02 |
| EP | 1389501 | A1 | * | 2/2004 | B21H 1/10 |
| EP | 2210682 | B1 | | 3/2012 | |
| JP | 2015221443 | A | * | 12/2015 | B21H 1/10 |
| KR | 10-2013-0099133 | A | | 9/2013 | |
| WO | 2012/042221 | A1 | | 4/2012 | |

OTHER PUBLICATIONS

An Office Action mailed by China National Intellectual Property Administration dated Jun. 16, 2020, which corresponds to Chinese Patent Application No. 201780084022.2 and is related to U.S. Appl. No. 16/476,013 with English language translation.

An Office Action mailed by the Korean Intellectual Property Office dated Oct. 5, 2020, which corresponds to Korean Patent Application No. 10-2019-7021598 and is related to U.S. Appl. No. 16/476,013 with English language translation.

European Search Report issued by the European Patent Office dated Jun. 18, 2020, which corresponds to EP20159889.3-1016 and is related to U.S. Appl. No. 16/476,013.

An Office Action mailed by the Korean Intellectual Property Office dated Apr. 21, 2021, which corresponds to Korean Patent Application No. 10-2019-7021598 and is related to U.S. Appl. No. 16/476,013; with English language translation.

* cited by examiner

METHOD AND DEVICE FOR SPIN FORMING

The invention relates to a method for spin forming, in particular for spin forming a vehicle wheel, wherein a workpiece is set in rotation about an axis of rotation by means of a spindle and at least one outer roller is positioned by means of an outer support at an outer side of the workpiece, wherein, with material thinning, an axially extending lateral region of the workpiece is shaped.

The invention relates further to a device for spin forming, having a spindle, which can be driven in rotation about an axis of rotation via a drive and is configured to hold a workpiece, at least one outer roller, which is rotatably mounted on an outer support, which is displaceable axially and radially relative to the axis of rotation in order to position it at the workpiece, and at least one inner roller, which can be positioned at an inner side of the workpiece opposite the outer roller.

In particular in the case of vehicle wheels, especially made of an aluminum material, they are spin-formed against a central spinning mandrel. The spinning mandrel, which is also called a spinning tool, thereby represents the negative form of the inside geometry of the rim of a vehicle wheel. A change in the rim usually also requires a change in the spinning mandrel, which is costly. Production of vehicle wheels or other spun parts with an inner contour is therefore frequently economical only for high piece numbers.

A method for spin forming that has increased flexibility in terms of shaping is known from EP 2 210 682 B1. In that known method, a variable spinning rod having a conical outer contour is provided as the spinning mandrel. The spinning rod is arranged concentrically with the axis of rotation. By axially displacing the spinning rod, a variable inside diameter can be provided at the shaped zone in question. However, this method is limited to specific inner contours.

From DE 35 45 506 A1 there is known a tool for spin forming hollow cylindrical workpieces. At the same time as outer rollers are positioned at an outer contour of the tubular workpiece, inner rollers are positioned at an outer contour by an inner roller carrier. Between the outer roller and the inner roller there is specified a fixed distance, which determines the circumference of an ironing spinning roller and the wall thickness of the tubular workpiece that is to be formed.

A similar method is known from U.S. Pat. No. 3,287,951. In that method, an outer roller and an associated inner roller are arranged on a common roller carrier. The outer roller is adjustable via a mechanical adjusting mechanism, so that the distance between the inner roller and the outer roller can be adjusted at the start of the shaping process.

Generic prior art is disclosed in WO 2012/042221 A1. On a hollow cylindrical workpiece, a single shaping roller is positioned at one side and two counter bearing rollers are positioned at the opposite side of the workpiece. Spinning is carried out with a constant wall thickness, or projection spinning is carried out with a given wall thickness reduction, which is dependent on the specified projection angle.

The object underlying the invention is to provide a method and a device for spin forming with which a particularly wide variety of shapes of workpieces can be produced flexibly and efficiently.

The object is achieved by the embodiments of the invention which are described below.

The method according to the invention is characterized in that at least one inner roller is positioned at an inner side of the workpiece by means of an inner support, which is displaceable axially and radially relative to the axis of rotation independently of the outer support, and in that the inner support with the inner roller and the outer support with the outer roller are displaced individually by means of a CNC control unit, wherein there is formed at the lateral region a defined wall thickness profile with different wall thicknesses between the at least one outer roller and the at least one inner roller.

A fundamental idea of the invention is to depart from a specified spinning tool which specifies a negative form of an inner contour of the workpiece and to provide at least one inner roller for shaping the inner contour. The inner roller is thereby not displaced linearly parallel to the outer roller, but the inner roller is mounted on an inner support which is displaceable axially and radially relative to the axis of rotation independently of the outer support. An almost unlimited variety of shapes can thus be produced without modifying a spinning tool.

There is further provided according to the invention a CNC control unit and preferably, in addition, programming support software which in particular is used offline on a PC. By means of the control unit, the inner support with the inner roller and the outer support with the outer roller are displaceable independently of one another. A free contour profile can thus be established on the inner side and on the outer side of the workpiece. Furthermore, by adjusting the outer roller relative to the associated inner roller, the active shaping gap and thus a wall thickness profile in the axial lateral region of the workpiece that is to be shaped can be formed with high shaping freedom. The expression spin forming is to be interpreted broadly within the meaning of the invention and includes not only shaping with a change in wall thickness but also spinning with a constant wall thickness.

By means of the method it is possible in an efficient manner to produce workpieces even in small piece numbers or even individual workpieces, since the expensive production of a rigid spinning mandrel is not necessary. Instead, the contour is freely established by correspondingly controlling the rollers relative to one another.

In a preferred embodiment of the invention, the at least one inner roller and the at least one associated outer roller are displaced radially and axially relative to one another in order to shape the lateral region. An individual profile of the inner contour and outer contour as well as a wall thickness profile arranged therebetween can thereby be established almost arbitrarily. According to a finding of the invention, the wall thickness is thereby determined not only by a radial distance of the inner roller relative to the outer roller. In particular in ironing spin forming, in which the lateral region is reduced as compared with an original starting thickness, the inner roller or the outer roller can purposively run axially ahead of or behind the respective other roller. A counter bearing function is thereby also achieved in an axial direction, which can be important for shape-accurate ironing.

According to a further embodiment variant of the invention, it is preferred that the workpiece is clamped on the spindle, wherein a free space remains in a central region radially inside the lateral region. The lateral region is of such a size that at least one inner roller can be positioned at an inner contour of the lateral region. For this purpose, the workpiece is preferably clamped on the spindle on one side, for example by means of a clamping chuck having three or more jaws. Other clamping mechanisms can be used, for example also with an axial clamping element or counterholding element which is positioned at or through a central opening at a hub region of the workpiece.

According to a further method variant according to the invention, it is advantageous that clamping of the workpiece takes place at a part-region of the outer circumference. The workpiece can thereby be held centered on the spindle from outside via corresponding clamping jaws.

According to a further development of the invention, it is preferred that the workpiece is provided with a clamping and/or centering aid before spin forming. The clamping chuck that is used is preferably provided with a centering means for centering the workpiece during the clamping operation. For this purpose, a corresponding centering aid can also be attached to the workpiece, which in particular in the case of cast wheels is molded on at the same time. This can be so formed, for example by means of projections or stop edges, that they assist the torque transfer from the clamping chuck to the workpiece.

According to a preferred further development, it is provided according to the invention that the clamping and/or centering aid is removed from the workpiece after spin forming. This can take place in particular by means of simple machining. This can also take place by means of a separate machine, for example a turning machine, or the spin forming device itself with an additional machining tool.

For particular gentle clamping, it is provided according to a preferred embodiment variant of the invention that an internal clamping device is provided, by which a hub region of the workpiece is covered. This is because shaping of the wheel preferably begins in the immediate vicinity of a radially extending hub region of the workpiece. In some vehicle wheel rims, these can be a star or rim spokes. The clamping device thereby has a relatively large plate-like clamping surface by which the hub region, which is of a particular shape and is preformed, is covered and protected.

In principle, the method according to the invention can be used to form any desired workpiece having an axially extending, tubular lateral region. It is particularly preferred according to a further development of the invention that the lateral region is in the form of a rim base of a vehicle wheel with at least one hump, which is formed as a thickening in the wall thickness profile. Further preferred is shaping of a case preform into a rim blank, which is subsequently processed further to form the finished wheel, in particular by machining.

By means of the method according to the invention it is thus possible to produce a largely weight-optimized vehicle wheel, in which the wall thickness profile of the rim base is adapted to the actual loading of the vehicle wheel in operation. Regions with low loading are thereby formed with a small wall thickness, while regions subjected to high loads are formed with a correspondingly large wall thickening. In addition, a hump, that is to say a bead for fixing the tire to the rim base, can likewise be formed in a simple manner by a wall thickening along the rim base. The hump represents an annular elevation on the rim base that projects radially outwards.

It is particularly advantageous that, to form a hump and/or flange region, the inner roller and the outer roller are simultaneously displaced relative to one another in the radial and axial direction. The lateral rim flanges can also be formed in a corresponding manner. For forming the rim flanges, further and other inner rollers with a changed and adapted outer contour can also be used. The same is true for the use of contoured outer rollers for forming the rim flanges. Owing to the freely programmable inner and outer rollers, stepwise shaping of the rim contour is additionally possible, so that greater strain hardening and/or structural changes can purposively be brought about in specific regions of the rim. Stability increases and/or weight reductions of the workpiece are possible as a result.

The device for spin forming according to the invention is characterized in that the at least one inner roller is rotatably mounted on an inner support, which is mounted to be displaceable axially and radially relative to the axis of rotation independently of the outer support, and in that a CNC control unit for individually displacing the at least one inner support with the inner roller and the at least one outer support with the outer roller is provided, wherein a wall thickness profile of the workpiece can be established between the inner roller and the outer roller.

The device according to the invention can be used in particular for carrying out the method described hereinbefore. The advantages described hereinbefore can thereby be achieved.

In a preferred embodiment of the device according to the invention, a plurality of inner rollers and outer rollers are provided, wherein an inner roller is associated with each outer roller. A plurality of inner rollers, preferably three inner rollers, are preferably arranged on a common roller carrier. In relation to this common roller carrier or inner support, the individual inner rollers can be pivotably displaceable relative to the axis of rotation. Purposive forming of the different contour regions of the workpiece can be achieved thereby. Depending on the use, it is possible in a further preferred form to provide inner rollers or inner supports which are separately displaceable axially and/or radially relative to one another.

According to a further development of the device according to the invention, it is preferred that a clamping device for clamping the workpiece is arranged on the spindle, wherein a free space remains in a central region radially inside the lateral region of the workpiece. The at least one inner support can be moved into that free space, so that an inner contour of the lateral region of the workpiece can be formed by the at least one inner roller.

For highly efficient manufacture, it is preferred according to an embodiment of the invention that there is provided a control device having a data memory, in which data sets for the displacement of the inner roller and the outer roller for different workpiece shapes are stored. In this manner, the desired data set for a specific workpiece form can be called up by a machine operator. Different workpieces can thus be produced efficiently on a spin forming device without an expensive modification. The device with the control device is provided via a remote data connection, in particular an internet connection. In this manner, new or updated data sets for existing or new workpieces can be transferred to the data memory of the machine. The device according to the invention can thus be provided for highly flexible use in industry 4.0 projects.

Furthermore, particularly good contouring can be achieved according to a further development of the invention in that at least one of the rollers is provided with an auxiliary drive for driving the roller in rotation. Both the inner rollers and the outer rollers can be provided with a respective roller drive. The inner and/or outer rollers can thereby be accelerated before they come into contact with the material of the rotating workpiece that is to be shaped. This counteracts baking on to the rollers and/or increased wear of the rollers. In a preferred form, the roller drive is designed with a free-wheel or speed controlling device which allows the circumferential speed of the roller to be automatically adjusted to the component.

For ejection from the clamping device, an ejector, in particular an axially displaceable ejector, can be used. Ejection is preferably carried out as a controlled movement. The device for spin forming is preferably in the form of a vertical machine with a suspended or alternatively upright spindle, so that centering of the workpiece is facilitated. In the form with a vertically suspended spindle, the counter-holder of the clamping device can also perform the function of loading and unloading.

The inner and/or outer supports are preferably in the form of independently controllable supports which are merely synchronized electrically. The outer roller is preferably set at an angle of from 0 to 15° relative to the axis of rotation, while the inner rollers are preferably set at from 0 to 45° and contribute to the shaping over a preferably significantly greater roller radius. The positioning of the outer and inner rollers is preferably carried out via two linearly operating cross-shaped supports. Alternatively, the use of at least two inner rollers on the cross-shaped support can be dispensed with by displacing or setting the rollers simultaneously via wedge-type slides.

Figure 2:
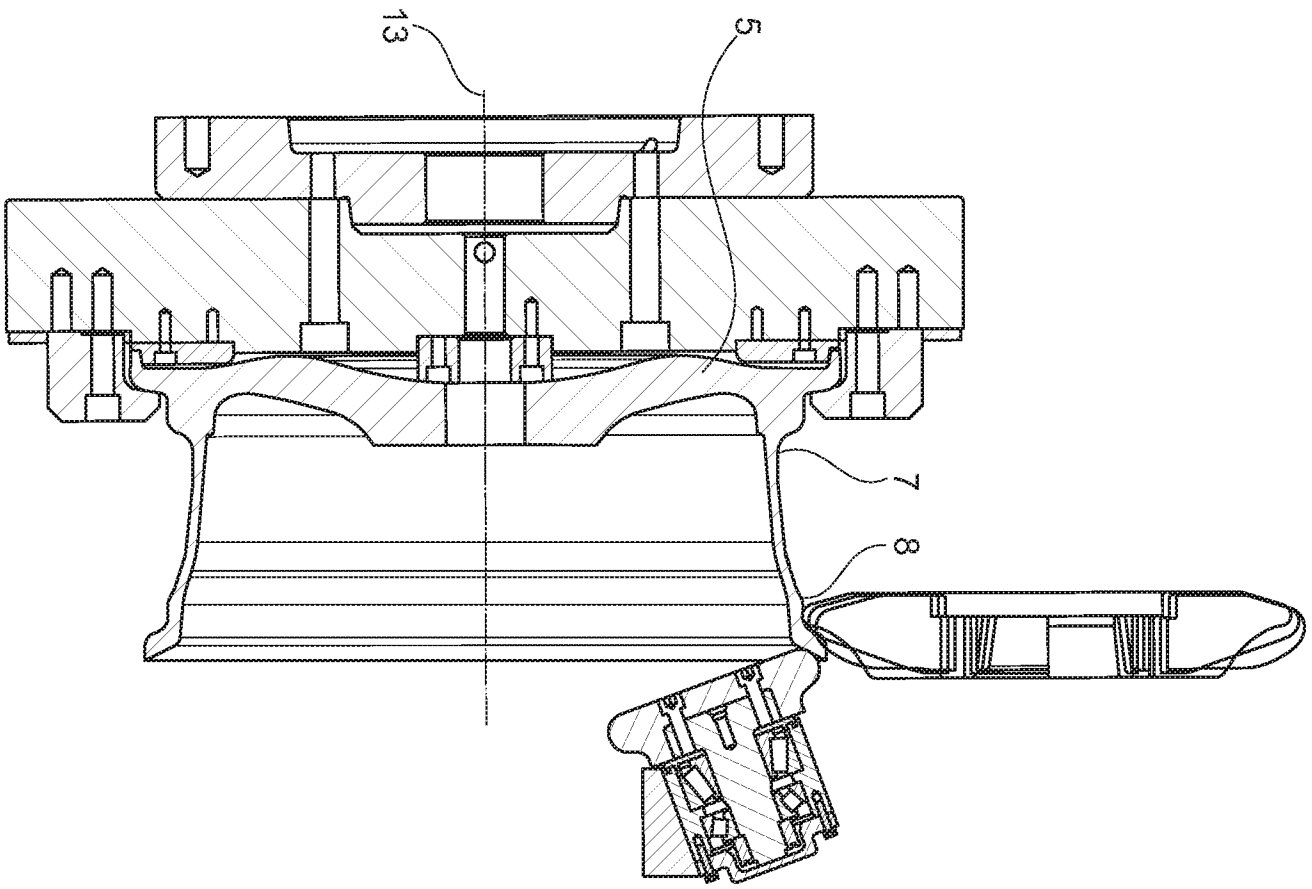
Figure 3:
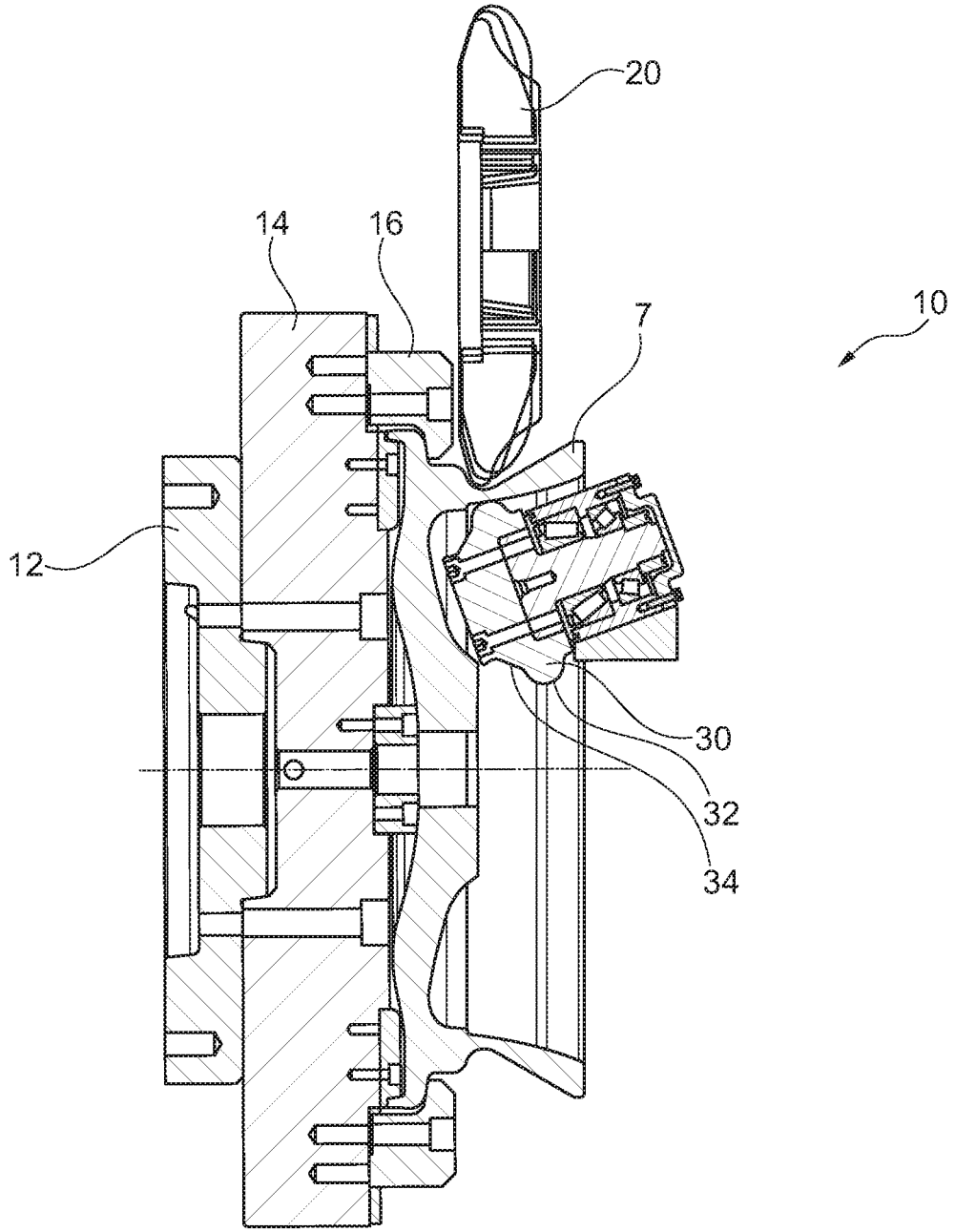
Figure 4:
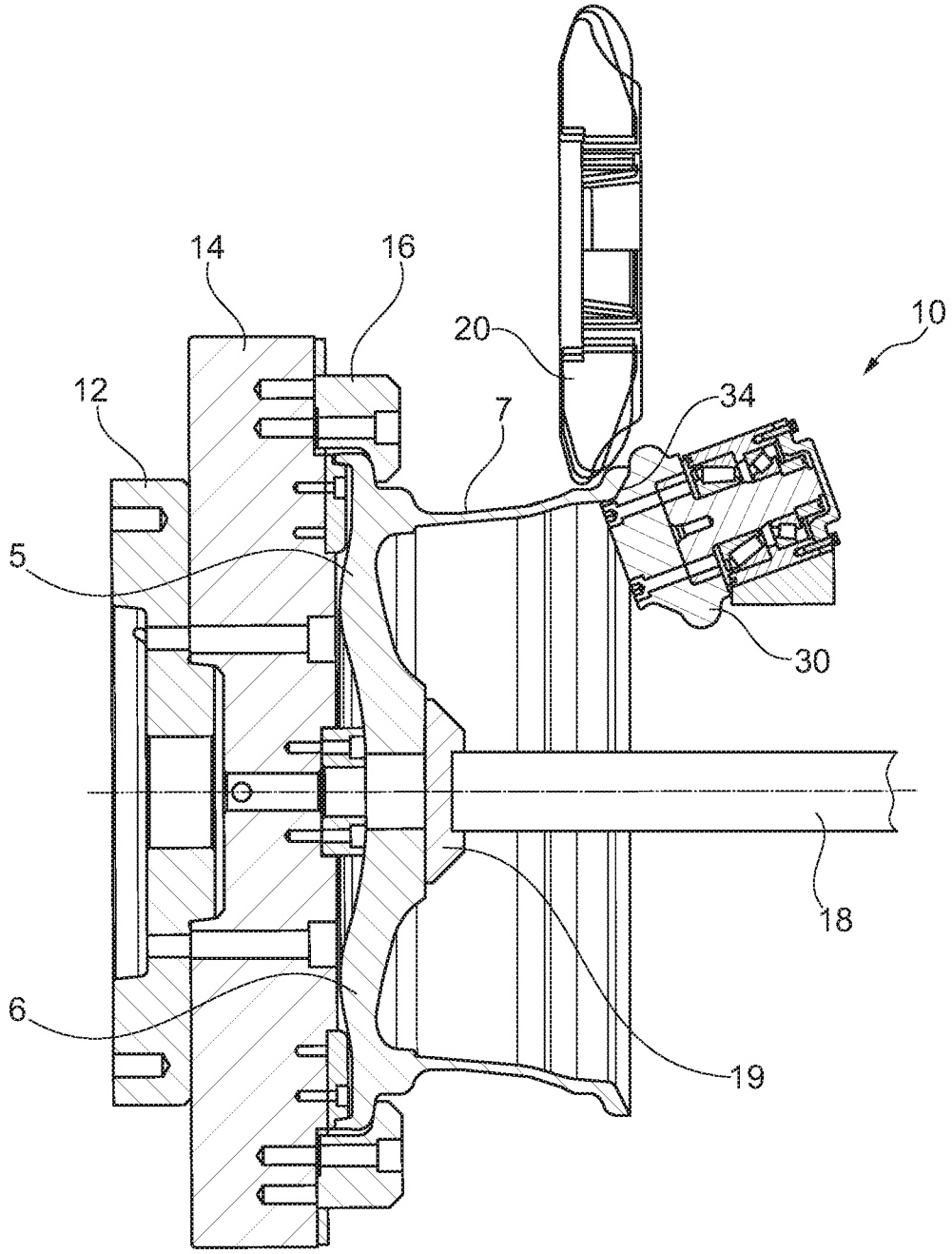

The invention will be described in greater detail hereinbelow by means of preferred exemplary embodiments, which are shown schematically in the drawings, in which:

FIG. 1: is a partial cross-sectional view of a device according to the invention during the shaping of a vehicle wheel in an initial stage;

FIG. 2: is a partial cross-sectional view of the device of FIG. 1 during the production of a vehicle wheel in an end stage;

FIG. 3: is a partial cross-sectional view of a further device during the production of a vehicle wheel in an initial stage; and FIG. 4: is a partial cross-sectional view of the device of FIG. 3 during the production of a vehicle wheel in an end stage.

A device 10 according to the invention for spin forming according to FIG. 1 has a spindle 12 which is driven in rotation via a drive (not shown). The spindle 12 rotates about a central axis of rotation 13, which in the example shown extends horizontally. The spindle 12 can likewise be oriented with the axis of rotation 13 vertical, a workpiece 5 then resting on the spindle 12 or, in the case of a suspended spindle arrangement, being clamped on a spindle 12 located at the top.

Via a plate-shaped clamping device 14 which is attached to the spindle 12 and has axially acting clamping claws 16, a workpiece 5 can be connected to the spindle 12 releasably and in a rotationally secure manner as well as centrally relative to the axis of rotation 13. In the exemplary embodiment shown, the workpiece 5 is a preform of a vehicle wheel. The preform is preferably manufactured from a metal material by casting or forging. The rotationally symmetrical workpiece 5 has a hub region 6 which extends substantially radially and has a central opening 4, and a drum-shaped lateral region 7 extending substantially axially. By means of the clamping claws 16, the workpiece 5 is fixed on one side at its outer circumference to the spindle 12.

After clamping, the spindle 12 with the workpiece 5 is set in rotation. Preferably three outer rollers 20, of which only one outer roller 20 is shown, are positioned radially at the outer side of the lateral region 7 of the workpiece 5 by means of outer supports (not shown). At the same time, an inner support 40 having three inner rollers 30 arranged offset by 120° relative to one another is positioned in a central free space inside the drum-shaped lateral region 7. The inner rollers 30 are thereby first applied to an inner side of the lateral region 7 adjoining the radial hub region 6.

The inner support 40 has a central and conical central carrier 42 on the outer side of which there are arranged linear guides 44 for slides 46. Roller holders 48 are pivotably mounted on the linearly displaceable slides 46. The inner rollers 30 are rotatably mounted in the cup-like roller holders 48 via roller bearings. The inner rollers 30 can be pivoted via the pivotable roller holders 48 during the spin forming operation and also displaced radially and/or axially by means of the slide 46 and the inner support 40. In a corresponding manner, the outer rollers can be mounted pivotably and also radially and axially displaceably on an outer support (not shown).

The displacement of the outer roller 20 and the inner roller 30 takes place via a CNC control unit (not shown) and actuating drives, on the basis of stored data for the shaping of the desired workpiece 5. As can be seen in FIG. 2, the lateral region 7 of the workpiece 5 can be shaped into a rim base with a hump 8, which represents a thickening in the wall thickness profile of the lateral region 7. The finished shaped lateral region 7 is lengthened compared with the lateral region 7 of the starting workpiece 5 and thinned in terms of wall thickness. It is possible to produce virtually any desired outer contour and also an inner contour using the device 10 according to the invention.

The second embodiment according to FIGS. 3 and 4 corresponds substantially to the construction of the first device 10 according to the invention according to FIGS. 1 and 2.

In contrast to the first embodiment, in the device 10 according to FIG. 3 a changed inner roller 30 having an annular radial projection 32 and an adjoining counter bearing portion 34 in the front region is provided. The radially protruding radial projection 32 on the inner roller 30, in conjunction with the outer roller 20 acting radially on the outside, can serve to shape an inner contour along the inner side of a lateral region 7 of the workpiece 5. The front counter bearing portion 34 can be used to form a rim flange at the free end of the shaped rim base, as is clearly shown in FIG. 4. The counter bearing portion 34 can in particular be a negative form of the inner contour of the rim flange and be designed to accommodate the shaping forces of the outer roller 20. In a corresponding manner, different outer rollers 20 having an adapted outer contour can be positioned at the lateral region 7. In particular, an outer roller 20 can have an outer contour corresponding to the desired shaping of the rim flange that is to be formed.

In the second embodiment according to FIGS. 3 and 4, an axially displaceable counter holder 18 is also additionally provided for clamping the workpiece 5, in addition to the clamping device 14 already described above having axially displaceable clamping claws 16 for clamping the workpiece 5 at the radial outer side. In particular after initial contouring of the lateral region 7, the counter holder 18 can be pushed axially against the hub region 6 of the workpiece 5 into the central free space of the drum-shaped lateral region 7. Additional axial clamping and centering of the workpiece can thereby take place at least during an end stage of the spin forming process. The counter holder 18 can have a plate-shaped contact element 19 (internal clamp) which is adapted to a contouring of the hub region 6 of the workpiece 5.

With the device 10 according to the invention and the method which can be carried out therewith, workpieces 5 can be formed with a wide variety of shapes of a wall region 7 without modification measures.

This method for the first time allows spin forming to be carried out multiple times and stepwise until the final geometry or complete structural change has been achieved.

Preferably spin forming of cast wheels at temperatures up to 400° C. Heat treatment of the wheels can immediately follow the spin forming operation.

In addition, the method can also be used for the cold forming of forged aluminum wheels as well as for steel wheels.

The use of a special programming interface or the use of offline programming support software is also preferred in order to allow the complex programs to be prepared more simply and quickly, as well as to test and optimize them by simulation prior to use.

Alternatively, a combination of flexible inner rollers with a partially acting short mandrel is also possible.

The invention claimed is:

1. A method for spin forming a vehicle wheel, comprising:

setting a workpiece about an axis of rotation using a spindle;

positioning at least one outer roller at an outer side of the workpiece, and shaping an axially extending lateral region of the workpiece by thinning the material of the workpiece, and wherein at least one inner roller is positioned at an inner side of the workpiece using an inner support, which is displaceable axially and radially relative to the axis of rotation and independently of the at least one outer roller, each of the at least one inner roller is associated with a respective one of the at least one outer roller, a defined shaping gap is formed between the outer roller and the associated inner roller, the at least one outer roller and the inner support with the at least one inner roller are displaced individually, a relative adjustment between the at least one outer roller and the associated at least one inner roller and thus of the shaping gap takes place, wherein a defined wall thickness profile with different wall thicknesses between the at least one outer roller and the associated at least one inner roller is formed at the lateral region, the at least one inner roller and the associated at least one outer roller are displaced radially and axially relative to one another in order to shape the lateral region, the lateral region is shaped as a rim base of a vehicle wheel with at least one hump, the at least one hump formed as a thickening in the wall thickness profile, in order to form the at least one hump, the at least one inner roller and the associated at least one outer roller are simultaneously displaced relative to one another in the radial direction and in the axial direction, and the at least one inner roller and the at least one outer roller are moved axially along the lateral region to form the rim base.

2. The method according to claim 1, wherein the workpiece is clamped on the spindle, and a free space remains in a central region radially inside the lateral region.

3. The method according to claim 1, wherein the workpiece is clamped at a part-region of an outer circumference of the workpiece.

4. The method according to claim 1, wherein an internal clamp is provided to cover a hub region of the workpiece.

5. A device according to the method of claim 1 for spin forming, wherein the spindle can be driven in rotation via a drive about an axis of rotation and is configured to hold a workpiece.

6. The device according to claim 5, wherein a clamp for clamping the workpiece is arranged on the spindle, and a free space remains in a central region radially inside the lateral region of the workpiece.

7. The device according to claim 5, wherein there is provided a control device having a data memory, in which data sets for the displacement of the at least one inner roller and the at least one outer roller for different workpiece shapes are stored.

* * * * *